US012168883B2

(12) United States Patent
Yang

(10) Patent No.: US 12,168,883 B2
(45) Date of Patent: Dec. 17, 2024

(54) TENT BASED ON EXTERNAL SUPPORT STRUCTURE

(71) Applicant: Zhejiang Hengfeng Top Leisure Co., Ltd., Zhejiang (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 136 days.

(21) Appl. No.: 18/097,542

(22) Filed: Jan. 17, 2023

(65) Prior Publication Data

US 2024/0068263 A1 Feb. 29, 2024

(30) Foreign Application Priority Data

Aug. 31, 2022 (CN) ..... 202222303420.X

(51) Int. Cl.

| | |
|---|---|
| ***E04H 15/42*** | (2006.01) |
| ***E04H 15/28*** | (2006.01) |
| ***E04H 15/32*** | (2006.01) |
| ***E04H 15/40*** | (2006.01) |
| ***E04H 15/64*** | (2006.01) |

(52) U.S. Cl.

CPC ..... *E04H 15/42* (2013.01); *E04H 15/28* (2013.01); *E04H 15/322* (2013.01); *E04H 15/405* (2013.01); *E04H 15/425* (2013.01); *E04H 15/64* (2013.01)

(58) Field of Classification Search

CPC ..... E04H 15/28; E04H 15/322; E04H 15/402; E04H 15/42; E04H 15/425

USPC .... 135/90, 98, 123, 143, 147, 153, 156, 159

See application file for complete search history.

(56) References Cited

U.S. PATENT DOCUMENTS

| | | | | |
|---|---|---|---|---|
| 88,514 A * | 3/1869 | Roebuck | ..... | E04H 15/48 135/147 |
| 2,948,287 A * | 8/1960 | Rupert | ..... | E04H 15/28 135/126 |
| 3,794,054 A * | 2/1974 | Watts | ..... | E04H 15/28 135/117 |
| 11,814,860 B1 * | 11/2023 | Huf | ..... | E04H 15/64 |

* cited by examiner

*Primary Examiner* — Robert Canfield

(74) *Attorney, Agent, or Firm* — Thompson Coburn LLP

(57) ABSTRACT

A tent is formed from a tarpaulin and support rods that form an external support structure. The support rods are radially connected to a top-middle connecting piece in the center of the top of the tent to form a tent ceiling. The tent ceiling is supported and maintains its shape by elastically reverse positioning of at least three support rods. The tarpaulin has a breach formed in the center. The top-middle connecting piece is connected with the tarpaulin on the top surface of the tent through a first connecting sheet. The first connecting sheet encloses the top-middle connecting piece and the breach at the center of the top of the tent to form a folding reserved space. The folding reserved space makes up the difference between the length of the support rods and the length of the fabric of the tent ceiling.

12 Claims, 3 Drawing Sheets

TENT BASED ON EXTERNAL SUPPORT STRUCTURE

RELATED APPLICATION DATA

This application claims priority benefit to Chinese utility model application Serial No. 202222303420.X which was filed on Aug. 31, 2022, the disclosure of which is incorporated by reference herein.

FIELD

The present application relates to the technical field of outdoor products, and in particular to a tent based on or supported by an external support structure.

BACKGROUND

A foldable tent in the conventional technology mostly includes a tent support frame and a tarpaulin covered on the tent support frame. The tent support frame includes multiple support rods which are radially connected to a top connecting seat at the center of the top of the tent to form a tent ceiling. The tent ceiling is supported by at least three support rods, and each support rod is pivotally or slidably connected by one leg tube or at least two leg tubes. For the tent in the conventional technology, the tarpaulin covers the outside of the tent support frame, and when the tent is opened for use, the tent support frame is located inside the tent, while the interior of the tent is use space for users, so the support frame inside the tent may affect the aesthetics of the tent during use and occupy the use space inside the tent. Therefore, a tent based on an external support structure is provided. The support frame of the tent is located outside the tarpaulin, and when the tent is opened for use, the support frame is located outside the tarpaulin, so that the support frame does not occupy the use space of the tent, and as the support frame is located outside the tarpaulin, the tent looks more beautiful from the inside for tent users. However, the tent with this structure has the following problems: in the market, there is a kind of tent that can be quickly supported by rods and the tent shape thereof can be maintained by elastically reverse positioning of the support rods. For the tent with this structure, when the support rods are arranged outside the tarpaulin, in order to achieve the same opening size of the tarpaulin, the length of the leg tube of the external support structure is longer, and it is easy to happen that the length of the leg tube exceeds an elastic extension range of the fabric. When folding, the leg tubes of the tent ceiling are folded downward, and the leg tubes connected to the center of the top of the tent are pressed against the tarpaulin below the leg tubes, and the tarpaulin may block the folding process and lead to the bursting of the fabric, resulting in the product being unable to be used normally.

SUMMARY

In order to solve the above problems, an object of the present application is to provide a tent based on an external support structure, and to optimize the tarpaulin structure of the tent ceiling, so that the tent based on the external support structure can be smoothly folded.

To achieve the above object, the following technical solutions are provided according to the present application.

A tent based on an external support structure includes multiple support rods which are radially connected to a top-middle connecting piece in the center of the top of the tent to form a tent ceiling. The tent ceiling is supported by at least three support rods, and a shape of a tarpaulin is maintained by elastically reverse positioning of the support rods. A breach is formed in the center of the tarpaulin on the top surface of the tent. The top-middle connecting piece is connected with the tarpaulin on the top surface of the tent through a first connecting sheet. The first connecting sheet encloses the top-middle connecting piece and the breach at the center of the top of the tent to form a folding reserved space, and the folding reserved space has a folding reserved height. When the tent is opened for use, the folding reserved space is located on an exterior side of the tarpaulin, that is, the side facing the outside when the tent is in use. When the tent is folded, the top-middle connecting piece drives the first connecting sheet to retract toward an interior side of the tarpaulin, where the interior side is the side facing the inside when the tent is in use.

Preferably, the first connecting sheet is made of a same fabric as the tarpaulin.

Preferably, the tarpaulin of the tent ceiling is connected with the respective support rod through a second connecting sheet, where the second connecting sheet forms a pipe sleeve, and the support rod is sleeved in the pipe sleeve formed by the second connecting sheet.

Preferably, the pipe sleeve of the second connecting sheet is formed by a gluing fabric sheet.

Preferably, the top-middle connecting piece includes a bottom plate and a connecting seat above the bottom plate, wherein the connecting seat is provided with at least three connecting grooves, the middle part of the connecting seat is provided with a central hole extending through the connecting seat and the bottom plate, each connecting groove is arranged along a radial direction of the connecting seat, all the connecting grooves are distributed in a circumferential array with the central hole as the center, and the respective support rod is connected into the corresponding connecting groove through a hinge.

Preferably, a screw is arranged at the central hole, one end of the screw forms a lifting ring, one end of the lifting ring is located below the bottom plate, and the extension lines of the axes of the support rods connected in the connecting grooves intersect at the central hole.

In the above structure according to the present application, since the folding reserved space makes up the difference between the length of the support rods and the length of the fabric of the tent ceiling, the support rods are not blocked by the tarpaulin of the tent ceiling when folded, and this structure also prevents the central tarpaulin of the tent ceiling from being broken by the support rods due to insufficient folding space.

REFERENCE NUMERALS IN THE FIGURES

1 support rod, 2 tarpaulin, 3 top-middle connecting piece, 31 bottom plate, 32 connecting seat, 4 first connecting sheet,

41 folding reserved space, 5 second connecting sheet, 61 screw, 62 lifting ring, 71 connecting sleeve.

DETAILED DESCRIPTION OF THE EMBODIMENTS

Figure 1:
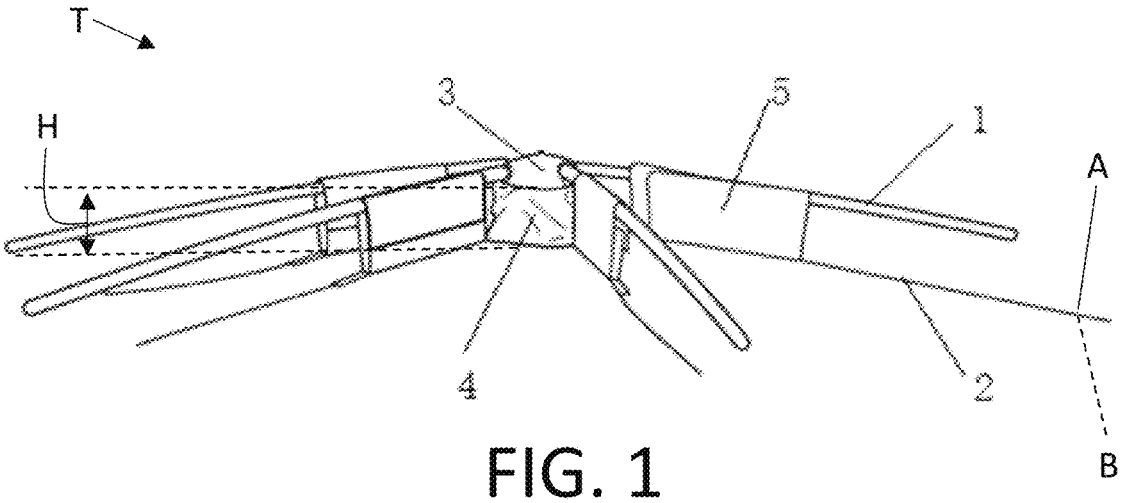
FIG. 1 is a schematic structural view of a tent ceiling when the tent is opened in this embodiment.
Figure 2:
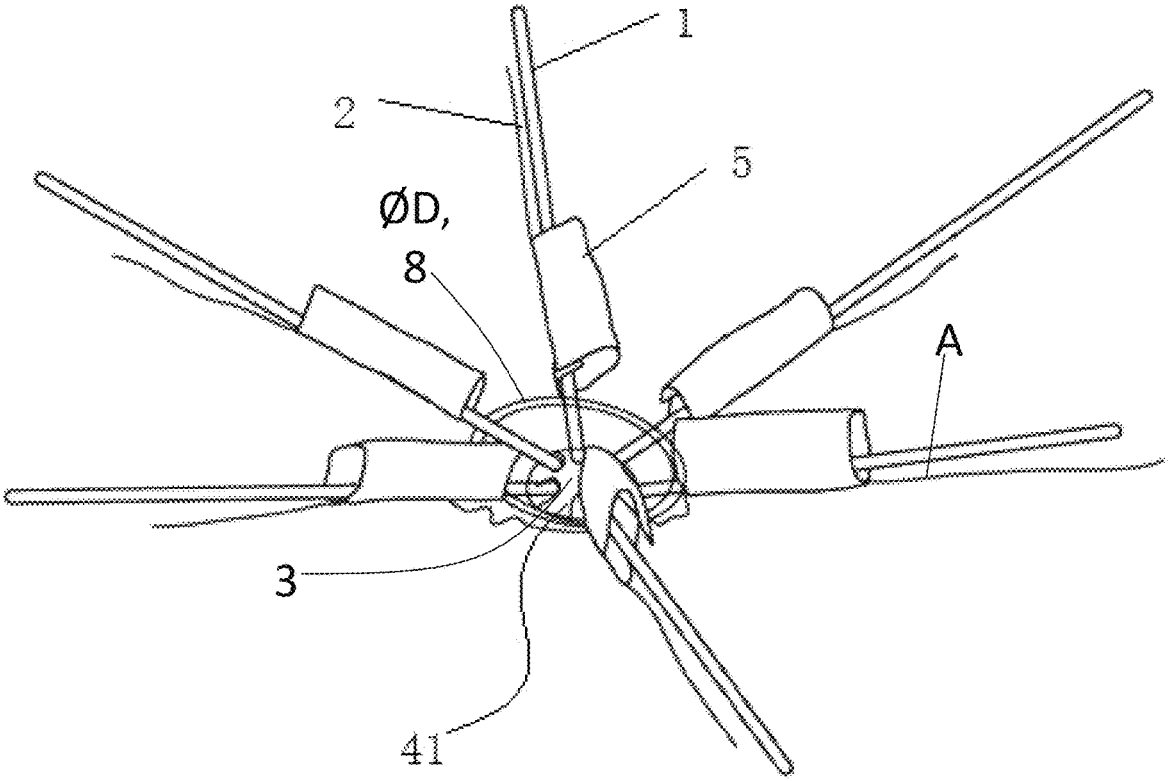
FIG. 2 is a schematic structural view of the tent ceiling in the process of folding the tent in this embodiment.
Figure 3:
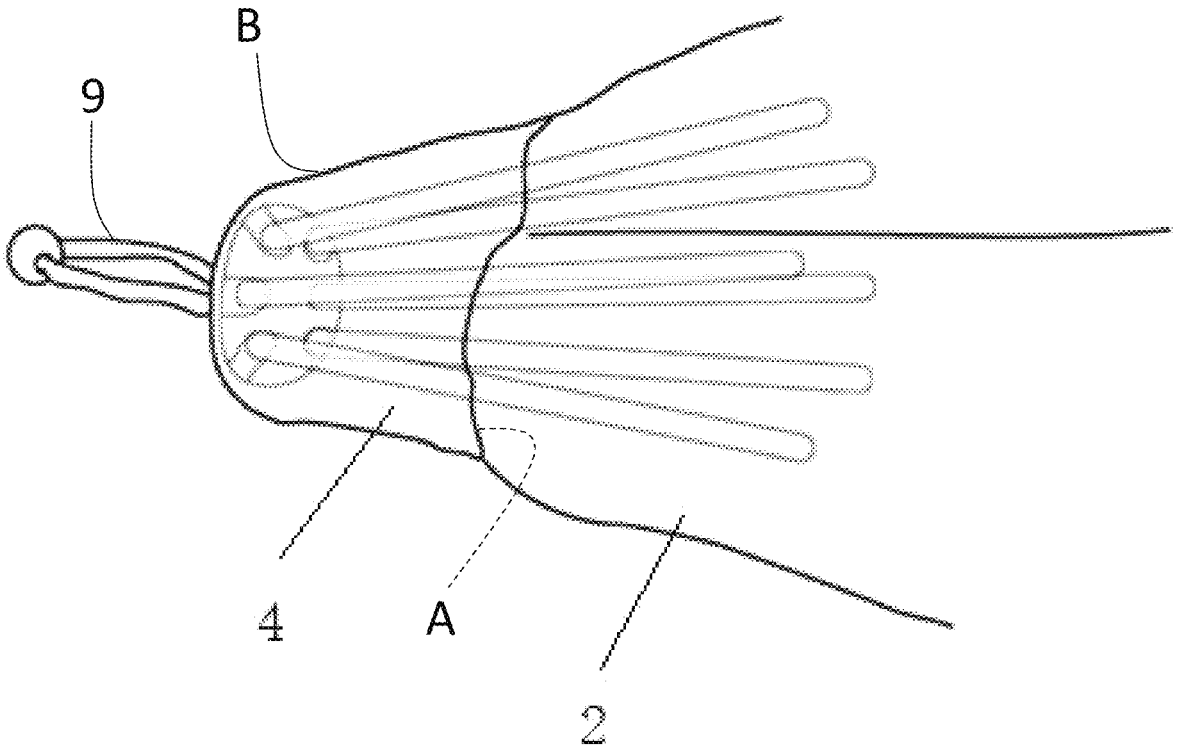
FIG. 3 is a schematic structural view of the tent ceiling after the tent is folded in this embodiment.
Figure 4:
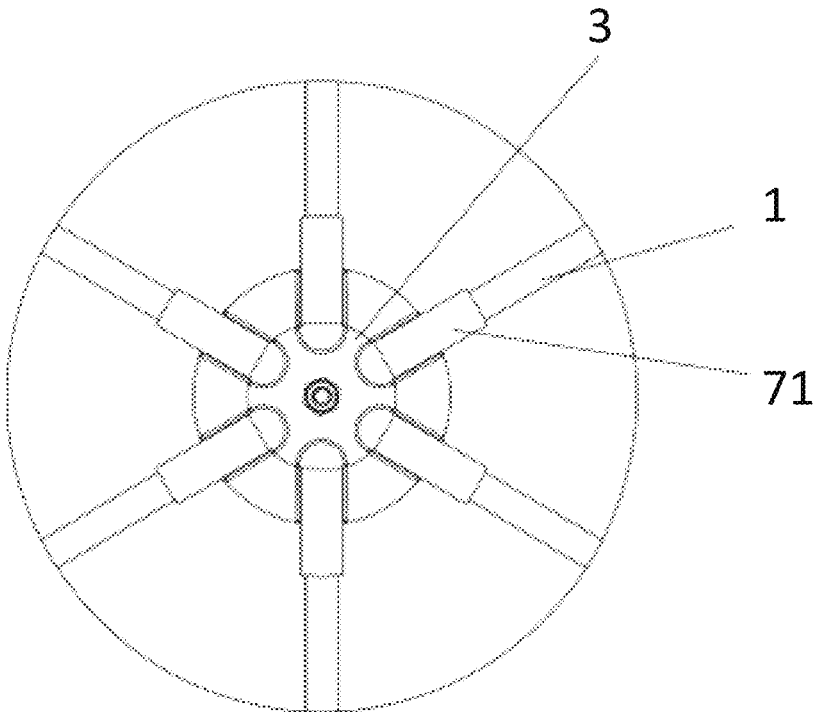
FIG. 4 is a schematic structural view of support rods connected to a top-middle connecting piece in this embodiment.
Figure 5:
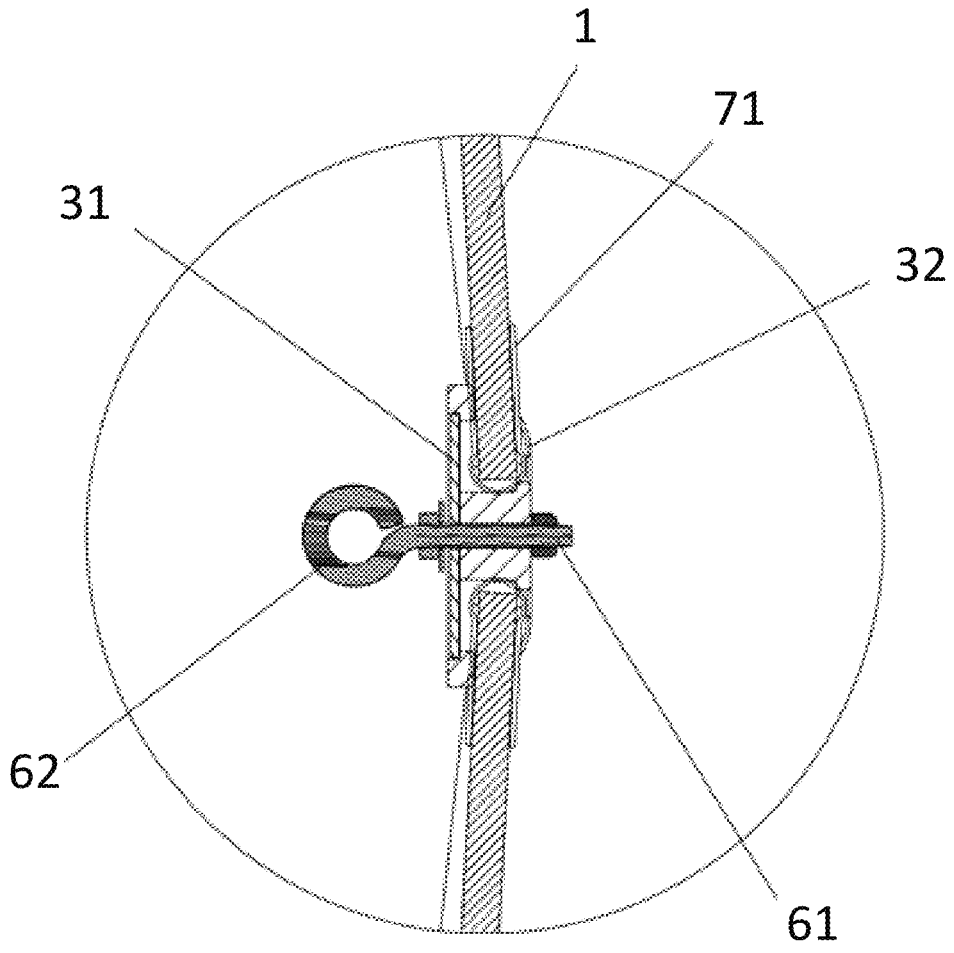
FIG. 5 is a schematic cross-sectional view of FIG. 4.

FIGS. 1 to 3 show a tent T based on an external support structure in this embodiment, including a tent support frame and a tarpaulin 2 connected with the tent support frame. The tent support frame includes multiple support rods 1 which are radially connected to a top-middle connecting piece 3 at the center of the top of the tent T to form a tent ceiling. The tent ceiling is supported by at least three support rods 1, and the shape of the tarpaulin 2 is maintained by elastically reverse positioning of the support rods 1. That is, the support rods 1 are pivoted at the connecting piece 3 against the connecting piece downward in FIG. 1, so the elastic return of the support rods supports the tarpaulin and forms the shape of the tarpaulin 2. In the embodiment, each support rod 1 can adopt a fiber rod to ensure the strength of the support rod 1 and reduce the weight of the support rod 1 while providing elasticity. As shown in FIG. 4 to FIG. 5, the multiple support rods 1 radially connected with the center of the top of the tent are jointly connected with the top-middle connecting piece 3, where the top-middle connecting piece 3 includes a bottom plate 31 and a connecting seat 32 above the bottom plate 31. The bottom plate 31 and the connecting seat 32 can be integrally formed or the bottom plate 31 and the connecting seat 32 can be connected by connecting pieces. The connecting seat 32 is provided with at least three connecting grooves, the middle part of the connecting seat 32 is provided with a central hole extending through the connecting seat 32 and the bottom plate 31, each connecting groove is arranged along a radial direction of the connecting seat 32, and all the connecting grooves are distributed in a circumferential array with the central hole as the center. The respective support rod 1 is connected into the corresponding connecting groove through a hinge, so that the support rod 1 can rotate relative to the connecting seat 32. Preferably, the support frame includes connecting sleeves 71, where each connecting sleeve 71 is hinged to the corresponding connecting groove, and one end of the respective support rod 1 is inserted into the corresponding connecting sleeve 71 and fixed. In this way, the assembly between the support rods 1 and the top-middle connecting piece 3 can be realized quickly without changing the structure of the support rods 1. Each support rod 1 is limited and elastically deflected by the bottom plate 31 in its rotation direction, so that a rotation range of the support rod 1 is approximately 90°. When the support rods 1 on the tent ceiling are rotated and folded, the support rods 1 connected to the same top-middle connecting piece 3 are roughly parallel to each other. When the support rods 1 are fully expanded to the service state, these support rods 1 are expanded to jointly support the tarpaulin 2 on the top of the tent. A screw 61 is arranged at the central hole, one end of the screw 61 forms a lifting ring 62, one end of the lifting ring 62 is located below the bottom plate 31, and the extension lines of the axes of the support rods 1 connected in the connecting grooves intersect at the central hole. Therefore, pulling the lifting ring 62 outwards can drive the connecting seat 32 to rotate relative to the support rods 1 to realize the rapid folding of the support rods 1 of the tent ceiling. Preferably, in order to facilitate the user to apply force, the lifting ring 62 is connected with a pull rope or carrying strap 9.

The quick support tent in the conventional technology relies on the elastic effect between the support frame and the fabric to maintain the shape of the tent body. Therefore, the difference between the length of the support rod 1 and the length of the fabric is a key factor affecting the folding of the product. In this application, the connection between the support frame and the tarpaulin 2 is improved, and a new tent based on an external support structure is proposed. As shown in FIG. 1 to FIG. 3, a folding reserved height H is reserved between the tarpaulin 2 on the top surface of the tent and its corresponding top-middle connecting piece 3, where the folding reserved height H is comprehensively determined according to the actual length of the support rod 1 and the elasticity of the tarpaulin 2, and can be set according to actual needs. A breach 8 is formed in the center of the tarpaulin 2 on the top surface of the tent, and a radial dimension of the breach OD is such determined that the top-middle connecting piece 3 and the support rods 1 connected thereto can pass through the breach 8 after the tent is completely folded. The top-middle connecting piece 3 is connected with the tarpaulin 2 on the top surface of the tent through a first connecting sheet 4 having the same fabric as the tarpaulin 2. The first connecting sheet 4 surrounds the top-middle connecting piece 3 and the breach 8 at the center of the top surface of the tent to form a folding reserved space 41. The height of the folding reserved space 41 is the folding reserved height H. When the tent is opened for use, the folding reserved space 41 is in communication with the use space inside the tent. The folding reserved space 41 is located on a side A of the tarpaulin 2, where the A side is the side facing outward when the tent is in use. When the tent is folded, the top-middle connecting piece 3 drives the first connecting sheet 4 to retract toward a side B of the tarpaulin 2, where the B side is the side facing the inside when the tent is in use. With such arrangement, since the folding reserved space 41 makes up the difference between the length of the support rods 1 and the length of the fabric of the tent ceiling, the support rods 1 are not blocked by the tarpaulin 2 of the tent ceiling when folded, and this structure also prevents the central tarpaulin 2 of the tent ceiling from being broken by the support rods 1 due to insufficient folding space.

Preferably, in the above structure, since there is a folding reserved height between the top-middle connecting piece 3 and the center of the tent ceiling, in order to maintain the folding reserved height, the tarpaulin 2 of the tent ceiling is connected with each support rod 1 through a second connecting sheet 5. After the tent is opened for use, the distance between the support rods 1 and the tarpaulin 2 of the tent ceiling is also the folding reserved height H. In other words, the second connecting sheet may have a dimension corresponding to the folding reserved height H. Preferably, the second connecting sheet 5 forms a sleeve by connecting lateral sides of the connecting sheet, for instance, by stitching, or gluing which can be a child-parent gluing belt. The support rod 1 extends thought the sleeve.

The application is used as follows. FIG. 1 shows the schematic view of the tent ceiling when the tent is opened. The way of opening the tent is similar to that in the conventional technology. The support rods 1 are rotated to be roughly in the same plane with respect to the top-middle connecting piece 3, and the support rods 1 are limited by the bottom plate 31 of the top-middle connecting piece 3 and elastically moved around the bottom plate to support the tarpaulin 2. When the tent is opened, the top-middle connecting piece 3 and the support rods 1 are located outside the tarpaulin 2, and the folding reserved space 41 is located on the A side of the tarpaulin 2. As shown in FIG. 2, during the folding process of the tent, the top-middle connecting piece 3 retreats into the folding reserved space 41, and then drives the first connecting sheet 4 to expand towards the B side of the tarpaulin 2, increasing the storage space for the top-middle connecting piece 3 and the support rods 1. As shown in FIG. 3, after the tent is folded, the folding reserved space 41 provides an additional storage space with the reserved height H, so that the support rods 1 have enough space to extend and are not blocked by the tarpaulin 2, the tarpaulin 2 is moderately tight, and the support rods 1 and the top-middle connecting piece 3 do not break the tarpaulin 2.

Although the embodiments of the present application have been shown and described above, it can be understood that the above embodiments are exemplary and cannot be construed as restrictions on the present application. Those skilled in the art can change, modify, replace and transform the above embodiments within the scope of the present application without departing from the principle and purpose of the present application.

The invention claimed is:

1. A tent adapted and configured to be supported by an external support structure, the tent comprising a plurality of support rods and a tarpaulin, the support rods being radially connected to a top-middle connecting piece in a center of a top of the tent to form a tent ceiling, the support rods being pivotally connected to the top-middle connecting piece such that the support rods pivot generally adjacent to each other when the tent is folded and the support rods extend outward and elastically deflect against the top-middle connecting piece when the tent is expanded, the tent ceiling being supported by at least three support rods, when the tent is expanded, the tarpaulin being supported by the support rods as the support rods elastically deflect against the top-middle connecting piece, the tarpaulin having a breach formed in the center of the tarpaulin at the top of the tent, the top-middle connecting piece being connected with the tarpaulin through a first connecting sheet, the first connecting sheet extending between the top-middle connecting piece and the tarpaulin at the breach at the center of the top surface of the tent to define a folding reserved space, the folding reserved space having a folding reserved height;

wherein when the tent is expanded and opened for use, the top middle connecting piece extends through the breach and the first connecting sheet extends from the top surface of the tarpaulin to the top middle connecting piece on an exterior of the tent, and when the tent is folded, the top-middle connecting piece retracts through the breach with the first connecting sheet toward an interior of the tent.

2. The tent according to claim 1, wherein the first connecting sheet is made of a same fabric as the tarpaulin.

3. The tent according to claim 1, wherein the tarpaulin of the tent ceiling is connected with respective support rod through a second connecting sheet, wherein the second connecting sheet forms a sleeve, and the respective support rod is extends through the sleeve formed by the second connecting sheet.

4. The tent according to claim 3, wherein the sleeve of the second connecting sheet is formed by connecting lateral sides of the second connecting sheet.

5. The tent according to claim 1, wherein the top-middle connecting piece comprises a bottom plate and a connecting seat above the bottom plate, the support rods are pivotally connected with the connecting seat.

6. The tent according to claim 5, wherein the connecting seat is provided with at least three connecting grooves, each connecting groove is arranged along a radial direction of the connecting seat, all the connecting grooves are distributed in a circumferential array, and the respective support rod is connected into the corresponding connecting groove through a hinge.

7. The tent according to claim 5, the middle part of the connecting seat is provided with a central hole extending through the connecting seat and the bottom plate, and a fastener is arranged at the central hole with one end of the fastener forming a lifting ring.

8. The tent according to claim 7 wherein the lifting ring is located below the bottom plate.

9. The tent according to claim 7 wherein the supports rods pivot away from the lifting ring when the tent is folded.

10. The tent according to claim 7 further comprising a carrying strap connected to the lifting ring.

11. The tent according to claim 5 wherein the support rods each have a center axis extending along a length of the support rod, and the center axes of the support rods intersect at a center of the top-middle connecting seat.

12. The tent according to claim 5 wherein support rods elastically deflect against the bottom plate when the tent is expanded.

* * * * *